US005876227A

United States Patent [19]

Kashiyama et al.

[11] Patent Number: 5,876,227

[45] Date of Patent: Mar. 2, 1999

[54] CONNECTOR FITTING APPARATUS

[75] Inventors: Motohisa Kashiyama; Hiroshi Aoki; Masanori Tsuji, all of Shizuoka-ken, Japan

[73] Assignee: Yazaki Corporation, Tokyo, Japan

[21] Appl. No.: 962,806

[22] Filed: Nov. 3, 1997

[30] Foreign Application Priority Data

Nov. 5, 1996 [JP] Japan ..... 8-292845

[51] Int. Cl.[6] ..... H01P 13/62

[52] U.S. Cl. ..... 439/157

[58] Field of Search ..... 439/157, 310

[56] References Cited

FOREIGN PATENT DOCUMENTS 4-56084 2/1992 Japan .

*Primary Examiner*—Neil Abrams
*Assistant Examiner*—Javaid Nasri
*Attorney, Agent, or Firm*—Finnegan, Henderson, Farabow, Garrett & Dunner, L.L.P.

[57] ABSTRACT

There is provided a connector fitting apparatus which can fit a female connector and a male connector to each other by taking advantage of a cam thrust force generated by swinging a lever member. In the fitting apparatus, a cover 23 is used as the lever member, and is formed with an opening 41 so as to be swingable to an electric wire withdrawal side of a female connector 25. When the cover is swung in the above manner, the electric wire withdrawal side is protected by the cover 23, and then, accompanying with the swing of the cover 23, an electric wire 29 is bent and oriented to a wiring direction, thus being led to the outside from the opening 41.

4 Claims, 3 Drawing Sheets

CONNECTOR FITTING APPARATUS

BACKGROUND OF THE INVENTION

1. Field of the Invention

The present invention relates to a connector fitting apparatus which fits a male connector and a female connector to each other with use of a cam.

2. Description of the Related Art

In the related art, there is a connection detecting apparatus for a connector, which has been disclosed in Japanese Patent Application Laid-Open No. 4-56084.

A connector fitting apparatus, to which the aforesaid connection detecting apparatus is applied, fits terminals of a male connector and a female connector to each other. The female connector is attached with a lever member which is swingable; on the other hand, the male connector is formed with a protrusion. The lever member is formed with a cam groove which is provided with a notch for making an engagement with the protrusion.

The cam groove moves the male connector so that the male connector approaches the female connector by taking advantage of a cam thrust force generated by a distance transfer from a point where the cam groove and the protrusion are fitted to each other to a center point of rotation of the lever member.

As described above, the male connector is moved so that it approaches the female connector, and by doing so, the male connector is led into the female connector side via the protrusion.

Also, the fitting of male and female connectors is released by rotating the lever member in a reverse direction.

In the case where connectors having many terminals are fitted to each other, a large fitting force is required; on the other hand, in case of releasing the fitting of these connectors, a large withdrawal force is required. However, as described above, by taking advantage of a cam thrust force, and further, double force function by the lever member, the fitting of these connectors and the release of the fitting thereof can be readily achieved by a small operational force.

These connectors are separately transported, and thereafter, are fitted to each other at a mounting place in vehicles, etc.

However, in case of transporting the female connector, there is the possibility that a terminal abutting end face, on which a female terminal is exposed, is broken down by an external force if it is not protected by a cover. In order to prevent the end face from being broken down, a strength of a certain degree is required, and also, a wall between terminal openings formed in the terminal abutting end face is not made thin. Therefore, a pitch of female terminals is not made narrow; for this reason, there is a limitation to the miniaturization of connector.

Moreover, since a group of electric wires connected to many female terminals are drawn out of the back side of the female connector, there is a need of attaching a cover to the back side so as to orient the direction of the group of electric wires to one direction.

As seen from the above description, in the aforesaid related art, two kinds of covers are required, and the number of components is too much; for this reason, it takes time to assemble, therefore, causing an increase in cost.

SUMMARY OF THE INVENTION

Taking the circumstances as described above into consideration, an object of the present invention is to provide a connector fitting apparatus which can easily fit connectors to each other, and has a function of protecting these connectors with fewer components and at a low cost.

To achieve the above object, according to a first aspect of the present invention, there is provided a connector fitting apparatus, comprising: a first connector having a terminal abutting end face, a bearing member and a wire withdrawn in a wire withdrawal side; a second connector having a protrusion, the second connector facing to the terminal abutting end face during the first and the second connectors being fitted in each other; a cover swingably connected to the first connector by the bearing member at a bearing portion of the cover, the cover having a notch and a cam groove continuously connected to the notch engaged with the protrusion, wherein the cam groove is formed to approach toward a center of the bearing portion while progressing to a distal end of the cam groove from the notch; and the wire is bent to be oriented to one direction and covered by the cover in the wire withdrawal side when the cover is swung in a first direction to fit the first and the second connectors.

As described above, in the connector fitting apparatus of the first aspect, the cover which operates as a lever member and a casing cover is swingable to the wire withdrawal side as a electric wire withdrawal side. Thus, when the cover is swung, the electric wire withdrawal side is protected by the cover, and then, the wire as an electric wire is bent into an opening side of the lever member accompanying with the swing of the lever member while being led to the outside from the opening so that the wiring direction of the electric wire is oriented to one direction.

Unlike the apparatus in the related art which includes the lever member having a single function, in the connector fitting apparatus of the present invention, since the cover for protecting the electric wire withdrawal side of the first connector is dispensed, the number of components is reduced, and also, the number of processes for attaching the cover is reduced; therefore, the cost can be reduced.

Further, as described above, since the wiring direction of the electric wire is oriented to one direction only by swinging the cover, it is convenient.

Furthermore, a cam constructed by the cam groove and the protrusion is operated by making use of a double force function generated by swinging the cover, and by doing so, the fitting of the first and the second connectors and the release of the fitting thereof can be readily performed with an extremely small operational force.

According to a second aspect of the present invention, as it depends from the first aspect, the terminal abutting end face is covered by the cover when the cover is swung in a second direction countering the first direction.

Therefore, with the above construction, the same effect as the first aspect can be obtained.

Further, the cover is operated so as to be swingable to the terminal abutting end face side, and by swing the cover in this manner, the terminal abutting end face is protected by the cover.

As described above, since the cover protects the terminal abutting end face, this serves to dispense an extra cover for protecting the terminal abutting end face side unlike the apparatus in the related art which includes the lever member having a single function. Therefore, the number of components and the number of processes for attaching the cover can be reduced, and the cost can be also considerably reduced.

Furthermore, the terminal abutting end face side is prevented from being broken down by an external force because being protected by the cover during transportation. Therefore, a wall between openings for receiving a terminal of the second connector which are formed in the terminal abutting end face is formed thin, so that pitch of female terminals of the first connector can be made narrow. Also, this makes it possible to miniaturize the second connector.

Thus, it is possible to arrange these connectors in a narrow place; therefore, it is convenient.

According to a third aspect of the present invention, as it depends from the first aspect or the second aspect, the connector fitting apparatus according to the first aspect, further comprising: a lock mechanism locking the cover, wherein the cover is locked in the wire withdrawal side when the cover is swung in the first direction; and the cover is locked in the terminal abutting end face when the cover is swung in the second direction.

Therefore, with the above construction, the same effect as the first and the second aspects can be obtained.

In addition, there is provided the lock mechanism for holding the cover which is swung to the electric wire withdrawal side to the position. Therefore, even if a reaction force of the bent electric wire is applied to the cover, the cover is held on the electric wire withdrawal side without being moved from the electric wire withdrawal side. Thus, a function of protecting the electric wire withdrawal side and a function of orienting the direction of the electric wire to one direction can be normally kept.

Also, there is provided another lock mechanism for holding the cover on a position which is swingable to the terminal abutting end face side. Therefore, the cover is held on the terminal abutting end face side without being moved from the terminal abutting end face side during the transportation of the first connector. Thus, a function of protecting the terminal abutting end face side can be normally kept.

According to a fourth aspect of the present invention, as it depends from any one aspect among the first aspect to the third aspect, the bearing portion of the cover is formed into a slot; the cover has a wall to be abutted against the first connector; and the cover is slidable to a position that the wall of the cover is abutted against the first connector in a longitudinal direction of the slot.

Therefore, with the above construction, the same effect as the first, the second and the third aspects can be obtained.

In addition, the bearing portion as a hole of the cover, which is fitted with the bearing member of the first connector side, is formed into a slot so that the cover is slidable. With the above construction, the cover is slidable to the position such that the wall as side walls of the cover and the first connector are abutted against each other, when the cover is swung to the electric wire withdrawal side or when it is swung to the terminal abutting end face side. And by doing so, there can be obtained a lock function or a lock force of locking the swing of the cover so as to hold the cover on the electric wire withdrawal side or the terminal abutting end face side. This dispenses the lock mechanism for holding the cover on the positions as described above; therefore, the cost reduction can be achieved.

Also, when the cover is slid to the counter direction, it is possible to prevent the swinging cover and the connectors from interfering with each other.

BRIEF DESCRIPTION OF THE ACCOMPANYING DRAWINGS

The above and further objects and novel features of the present invention will more fully appear from the following detailed description when the same is read in conjunction with the accompanying drawings, in which:

FIG. 1 is a perspective view showing a fitting apparatus according to a first embodiment of the present invention;

FIG. 2 is a perspective view showing a state in which a cover is swung to a terminal abutting end face side of a female connector in the first embodiment; and FIG. 3 is a perspective view showing a fitting apparatus according to a second embodiment of the present invention, and shows a state in which the cover is swung to an electric wire withdrawal side of the female connector, and the female connector and a male connector are fitted to each other.

DETAILED DESCRIPTION OF THE PREFERRED EMBODIMENTS

Figure 1:
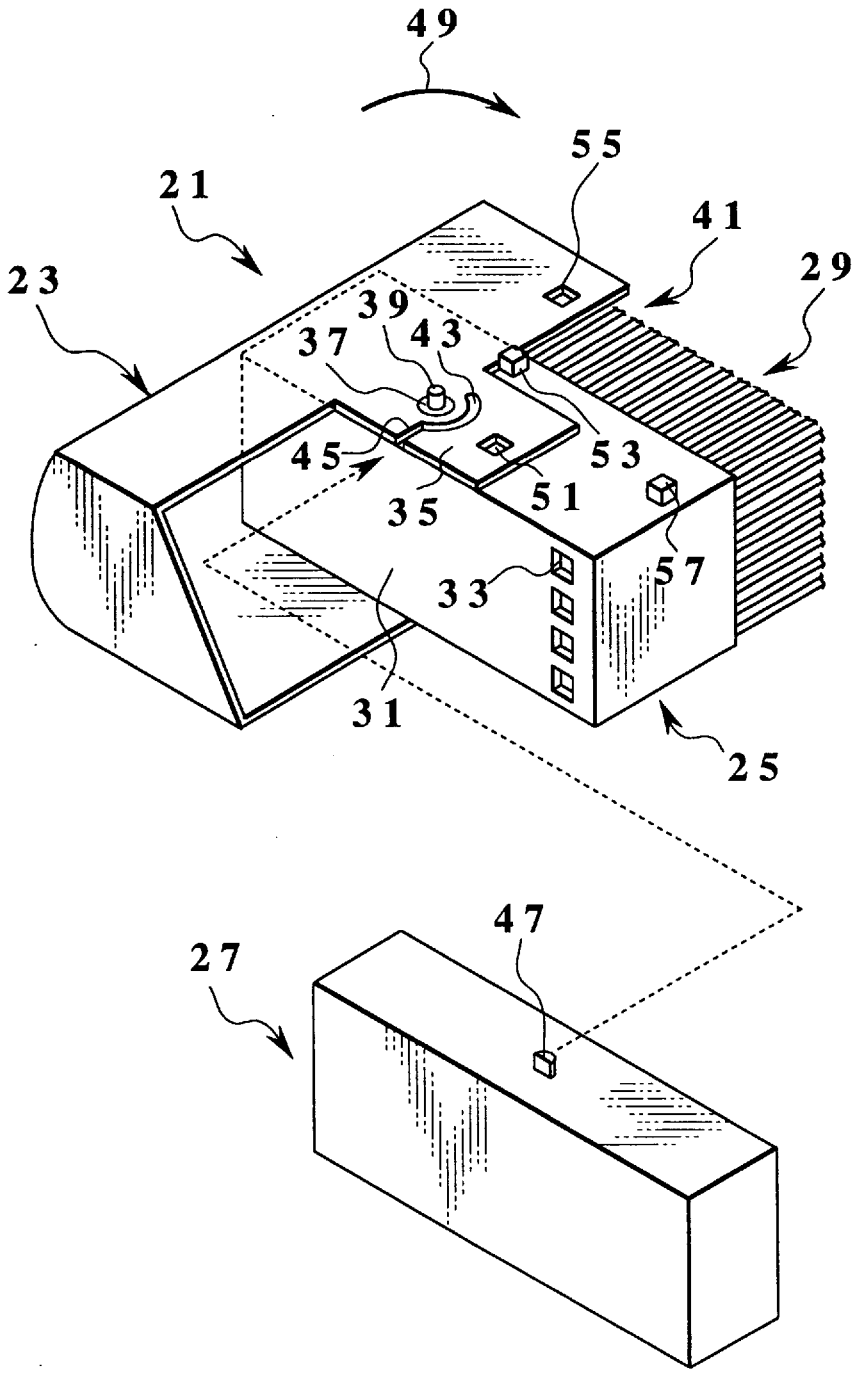

There will be detailed below the preferred embodiments of the present invention with reference to the accompanying drawings. Like members are designated by like reference characters.

A first embodiment of the present invention will be described below with reference to FIG. 1 and FIG. 2.

As shown in FIG. 1, a fitting apparatus 21 of this embodiment fits a female connector 25 as a first connector and a male connector 27 as a second connector to each other by a swing operation of a cover 23.

A great many of female terminals are received in the female connector 25, and a group of electric wires 29 as a wire connected to these female terminals is drawn out of one side corresponding an electric wire withdrawal side as a wire withdrawal side of the female connector 25. The reverse side, that is, the other side of the female connector 25 is a terminal abutting end face 31 which is formed with a female terminal openings 33. The female connector 25 is applicable for optical wire other than the electric wires 29.

The cover 23 is made of plastic and has a proper flexibility. The cover 23 is provided with a proximal portions 35 which face each other in a vertical direction. Each of the proximal portions 35 is formed with a round hole 37 as a bearing portion. Also, each of an upper and lower end faces of the female connector 25 is provided with a protrusion 39 as a bearing member. The cover 23 is swingably connected to the female connector 25 by an engagement of the protrusion 39 with the round hole 37.

Figure 2:
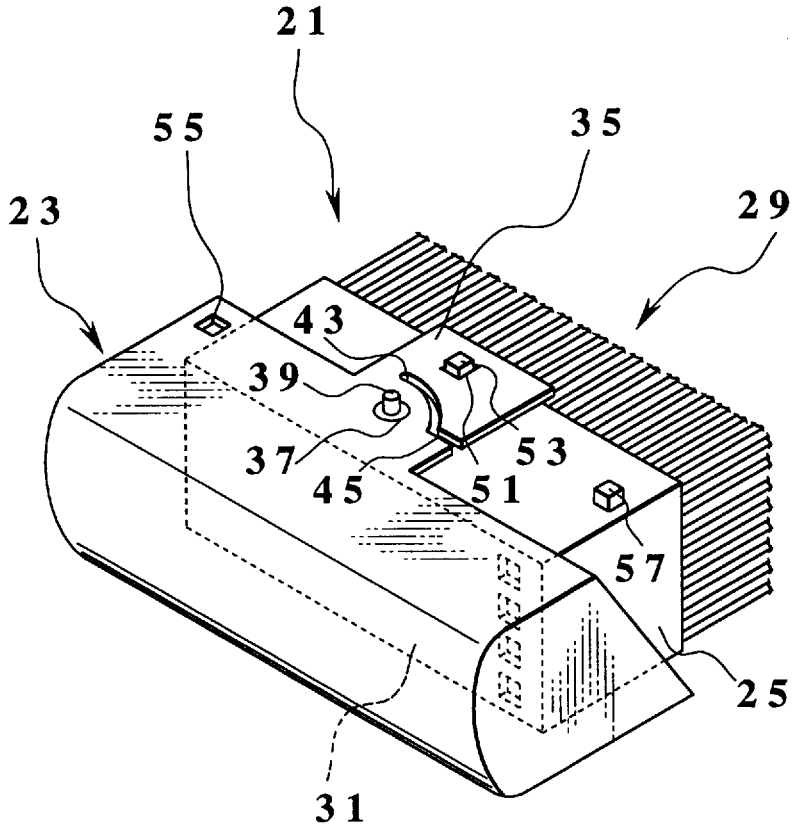

As seen from FIG. 2, the cover 23 is swingably movable to the terminal abutting end face 31 side, and also, is swingably movable to the withdrawal side of the group of electric wires 29. Further, the cover 23 is formed with an opening 41 in a swingable direction to the withdrawal side of the group of electric wires 29.

Each proximal portion 35 of the cover 23 is formed with an arc-like cam groove 43 which has a notch 45. The cam groove 43 is formed so as to be near to the center of the aforesaid round hole 37 while approaching toward the distal end thereof away from the notch 45.

On the other hand, the male connector 27 is provided with a protrusion 47 as an engaging portion engaging with the cam groove 43. The protrusion 47 is fitted into the cam groove 43 from the notch 45 along an arrow shown by a broken line in FIG. 1.

The aforesaid cam groove 43 and protrusion 47 constitutes a cam mechanism. Thus, when the cover 23 is swung to a direction indicated by an arrow 49 shown in FIG. 1, the point where the protrusion 47 is fitted into the cam groove 43 gradually approaches the center of the swing of the cover 23 (protrusion 39), thereby a cam thrust force being generated.

Therefore, the protrusion 47 of the male connector 27 is fitted into the cam groove 43 through the notch 45, and thereafter, when the cover 23 is swung to the arrow 49 direction, the male connector 27 is led into the female connector 25 via the protrusion by taking advantage of the aforesaid cam thrust force, thus terminals of these connectors being fitted to each other.

Also, when the cover 23 is swung to a direction reverse to the arrow 49 direction, the fitting of these connector 25 and 27 is released by a cam thrust force acting in a counter direction.

In the case where these connectors are transported to a mounting place, as shown in FIG. 2, the transportation of these connector is carried out in a state in which the cover 23 is swung to the terminal abutting end face 31 side.

The proximal portion 35 of the cover 23 is formed with a square hole 51. Each of an upper and lower end faces of the female connector 25 is provided with a protrusion 53 which is fitted into the square hole 51. The square hole 51 and the protrusion 53 constitute a lock mechanism. When the cover 23 is swung to the terminal abutting end face 31 side, the protrusion 53 is fitted to the square hole 51 so that the lock mechanism is operated, and then, the cover is held at the position as described above.

As seen from the above description, during transportation, since the terminal abutting end face 31 of the female connector 25 is protected by the cover 23, there is no possibility that the terminal abutting end face 31 is broken down due to an external force.

Moreover, the cover 23 is formed with square holes 55 and 55 at the opening 41 side. Each of an upper and lower end faces of the female connector 25 is provided with a protrusion 57 which is fitted into the square hole 55. The square hole 55 and the protrusion 57 constitute a lock mechanism.

When the cover 23 is swung to the withdrawal side of the group of electric wires 29, the protrusion 57 is fitted to the square hole 55 so that the lock mechanism is operated, and then, the cover 23 is held at the position as described above.

The withdrawal side of the group of electric wires 29 is protected by swing the cover 23 thereto, and then, the group of electric wires 29 is bent by the swing of the cover 23 and is led to the outside from the opening 41, so that a wiring direction of the group of electric wires 29 can be oriented to one direction.

In the manner as described above, the fitting apparatus 21 of the first embodiment is constructed.

As described above, a cam thrust force is generated by the fitting of the cam groove 43 and the protrusion 47, and further, the cam thrust force is increase by a double force function by the swing of the cover 23, so that the fitting apparatus 21 can perform fitting of the female connector 25 and the male connector 27 and a release of the fitting of these connectors by an extremely small operational force.

Unlike the conventional apparatus which includes a lever member having a single function, the cover 23 is used as the lever member in the fitting apparatus of the present invention. This serves to dispense a cover for protecting the electric wire withdrawal side of the female connector 25; as a result, the number of components can be reduced. Moreover, a work for attaching the aforesaid cover is omitted; therefore, the cost can be reduced.

As described above, the wiring direction of the electric wires can be oriented to one direction by only swinging the cover 23.

During transportation, since the terminal abutting end face 31 is protected by the cover 23, a cover for protecting the terminal abutting end face 31 is dispensed, unlike the conventional apparatus which includes a lever member having a single function. This serves to reduce the number of components, and a work for attaching the aforesaid cover is omitted; therefore, the cost can be reduced.

Also, as described above, since there is no possibility that the terminal abutting end face 31 is broken down during its transportation, no problem is caused in its strength even if the wall between terminal openings 33 is made thin.

Thus, the pitch of the female terminals is made narrow; therefore, the female connector 25 can be miniaturized. Moreover, the male connector 27 is also miniaturized accompanying with the miniaturization of the female connector 25. This serves to make small an arrangement space in mounting.

In addition, since there is provided a lock mechanism 55 and 57 for holding the cover 23 on the electric wire withdrawal side, the cover 23 is prevented from being moved from the electric wire withdrawal side by a reaction force of the electric wire which is bent by the cover 23. Therefore, a function of protecting the electric wire withdrawal side and a function of orienting these electric wires to one direction can be normally kept.

Further, since there is provided a lock mechanism 51 and 53 for holding the cover 23 on the terminal abutting end face 31 side, the cover 23 is prevented from being moved from the terminal abutting end face 31 during the transportation of the female connector 25. Therefore, a function of protecting the terminal abutting end face 31 can be normally kept.

Next, a second embodiment of the present invention will be described below with reference to FIG. 3.

In a fitting apparatus of this embodiment 59, each proximal portion 35 of the cover 23 is formed with a slot 61 corresponding to the round hole 35 as the bearing portion in the first embodiment. The protrusion 39 provided on each of upper and lower surfaces of the female connector 25 is fitted into the slot 61, thereby the cover 23 being swingably connected to the female connector 25.

Also, the cover 23 is slidable along the extending direction of the slot 61 because the protrusion 39 is fitted into the slot 61.

A swing operation of the cover 23 is carried out in a state in which the cover 23 is slid so that the protrusion 39 is situated on a position of the slot 61 as shown by an arrow 65. By doing so, the cover 23 can be swung without interfering with connectors 25 and 27.

In the case where these connector are transported to a mounting place, the cover 23 is swung to the terminal abutting end face 31 side of the female connector 25 so as to protect it, like the first embodiment described before.

Figure 3:
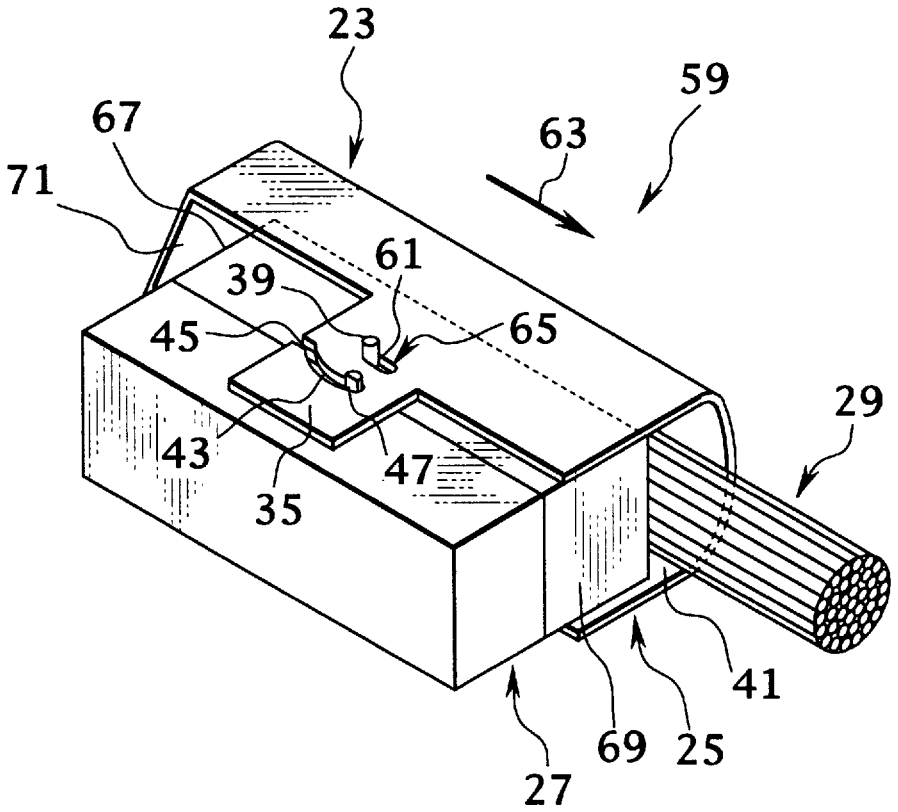

When the cover is swung up to a position shown in FIG. 3 in a state in which the protrusion 47 of the male connector 27 is fitted into the cam groove 43 from the notch 45, the male connector 27 is led into the female connector 25 side by a cam thrust force, and then, terminals of these connectors are fitted to each other.

Also, when the cover 23 is swung in the manner as described above, the group of electric wires 29 is bent so that the wiring direction is oriented to an opening 41 side, and then, is drawn and led to the outside.

These connectors 25 and 27 are fitted to each other, and thereafter, when the cover 23 is moved to a direction shown by an arrow 63 so that a side wall 71 as a wall of the cover 23 is abutted against a side wall 67 of the female connector 25, a lock function for locking the swing of the cover 23 is obtained, so that the cover 23 can be kept at the position as described above.

Since the lock mechanism receives a reaction by the group of electric wires 29, the cover 23 is prevented from being moved from the electric wire withdrawal side, and protects the electric wire withdrawal side. In this manner, a function of orienting the direction of the electric wires to one direction can be normally kept.

When these connectors are transported to a mounting place, the cover 23 is slid so that the side wall 71 is abutted against a side wall 69 of the female connector 25, and by doing so, a lock function for holding the cover 23 to this position is obtained. Thus, a function of protecting the terminal abutting end face 31 can be normally kept.

In the manner as described above, the fitting apparatus 59 of the second embodiment is constructed.

Like the fitting apparatus 21 of the first embodiment, the fitting apparatus 59 can readily perform the fitting of these connectors 25 and 27 and the release of the fitting thereof with an extremely small operational force. Moreover, since the cover 23 is used as a lever member, this serves to dispense two kinds of covers for protecting the electric wire withdrawal side of the female connector 25 and the terminal abutting end face 31 side thereof. Therefore, the number of components and the number of processes for attaching the cover can be reduced, and the cost can be also considerably reduced.

Further, the wiring direction of the electric wires can be oriented to one direction by only swing the cover 23.

Furthermore, since the terminal abutting end face 31 is prevented from being broken down during transportation, the pitch of the female terminals can be made narrow. This makes it possible to miniaturize the female connector 25; therefore, the male connector 27 can be also miniaturized.

In addition, the cover 23 is slidable along the slot 61, and a lock function is provided. This serves to dispense a lock mechanism for holding the cover 23 on the electric wire withdrawal side and the terminal abutting end face 31 side; therefore, the cost can be further reduced.

While preferred embodiments of the present invention have been described using specific terms, such description is for illustrative purposes, and it is to be understood that changes and variations may be made without departing from the spirit or scope of the following claims.

What is claimed is:

1. A connector fitting apparatus, comprising:

a first connector having a terminal abutting end face, a bearing member and a wire withdrawn in a wire withdrawal side;

a second connector having a protrusion, the second connector facing to the terminal abutting end face during the first and the second connectors being fitted in each other;

a cover swingably connected to the first connector by the bearing member at a bearing portion of the cover, the cover having a notch and a cam groove continuously connected to the notch engaged with the protrusion, wherein the cam groove is formed to approach toward a center of the bearing portion while progressing to a distal end of the cam groove from the notch; and the wire is bent to be oriented to one direction and covered by the cover in the wire withdrawal side when the cover is swung in a first direction to fit the first and the second connectors.

2. The connector fitting apparatus according to claim 1, wherein the terminal abutting end face is covered by the cover when the cover is swung in a second direction countering the first direction.

3. The connector fitting apparatus according to claim 1, further comprising:

a lock mechanism locking the cover, wherein the cover is locked in the wire withdrawal side when the cover is swung in the first direction; and the cover is locked in the terminal abutting end face when the cover is swung in the second direction.

4. The connector fitting apparatus according to claim 1, wherein the bearing portion of the cover is formed into a slot;

the cover has a wall to be abutted against the first connector; and the cover is slidable to a position that the wall of the cover is abutted against the first connector in a longitudinal direction of the slot.

* * * * *